US007540471B2

(12) United States Patent
Hall

(10) Patent No.: US 7,540,471 B2
(45) Date of Patent: Jun. 2, 2009

(54) HOARDING CONSTRUCTION

(76) Inventor: Richard Hall, 116 Turkey Street, Enfield (GB) EN1 4PS ( * ) Notice: Subject to any disclaimer, the term of this patent is extended or adjusted under 35 U.S.C. 154(b) by 686 days.

(21) Appl. No.: 11/122,628

(22) Filed: May 5, 2005

(65) Prior Publication Data

US 2006/0248849 A1 Nov. 9, 2006

(51) Int. Cl.
*E04H 17/16* (2006.01)

(52) U.S. Cl. ..... 256/31; 256/1; 256/24; 256/30; 256/63; 256/DIG. 6

(58) Field of Classification Search ..... 256/1, 256/24, 30, 31, 63, 64, DIG. 6; 404/28, 29
See application file for complete search history.

(56) References Cited

U.S. PATENT DOCUMENTS

| | | | | |
|---|---|---|---|---|
| 4,383,782 | A * | 5/1983 | Pillifant, Jr. | 256/64 |
| 5,611,641 | A * | 3/1997 | Christensen | 256/1 |

FOREIGN PATENT DOCUMENTS

| | | | |
|---|---|---|---|
| DE | 297 18 815 | U1 | 10/1997 |
| FR | 2696491 | A1 * | 4/1994 |
| GB | 1 364 885 | | 8/1974 |
| GB | 1364885 | A * | 8/1974 |
| GB | 2 295 406 | | 5/1996 |
| GB | 2 360 531 | | 9/2001 |
| GB | 2 406 105 | | 3/2005 |
| WO | WO-9831899 | | 7/1998 |
| WO | WO 9831899 | A1 * | 7/1998 |

* cited by examiner

*Primary Examiner*—Victor MacArthur
(74) *Attorney, Agent, or Firm*—Lerner, David, Littenberg, Krumholz & Mentlik, LLP

(57) ABSTRACT

A hoarding comprising wall elements and one or more wall supports, in which each wall support comprises a trough and a post, in which the trough is substantially rectangular in shape and has a first end and a second end, and in which in use the post is disposed substantially vertically at the first end of the trough, in which in use the post carries the wall elements, in which the trough is disposed behind the wall elements in use and is arranged perpendicular to the wall elements, and in which the trough carries ballast in use.

17 Claims, 2 Drawing Sheets

HOARDING CONSTRUCTION

BACKGROUND OF THE INVENTION

This invention relates to a novel hoarding construction for use particularly, but not exclusively, at building sites.

Temporary hoardings are often erected around building sites, or other enclosures, to prevent intruders gaining access, and to protect passers by from the building work. Although they are temporary, such hoardings need to be secure.

It is common to provide a series of posts which are fixed into the ground, to which a sheeting is attached. However, this arrangement can be costly and time consuming to construct, in particular when the ground is paved or concreted.

In addition, if the ground is soft, in a field for example, these arrangements can suffer from failure in adverse weather conditions.

Further, the parts used in the above described hoardings may not be reusable after they have been deconstructed.

The present invention is intended to overcome some of the above problems.

SUMMARY OF THE INVENTION

Therefore, according to the present invention a hoarding comprises wall elements and one or more wall supports, in which each wall support comprises a trough and a post, in which the trough is substantially rectangular in shape and has a first end and a second end, and in which in which in use the post is disposed substantially vertically at the first end of the trough, in which in use the post carries the wall means, in which the trough is disposed behind the wall means in use and is arranged perpendicular to the wall means, and in which the trough carries ballast in use.

In one construction the post can be mounted inside the trough, but in a preferred construction the post can be connected to an outside surface of the trough.

In one construction a brace can extend from a second end of the trough to the top of the post, to support it.

The wall elements may comprise one or more rails mounted to the post of each wall support, and arranged substantially parallel to the ground, and a sheeting carried on the rails.

The sheeting can be disposed in front of the trough, and can extend to the ground.

Preferably the trough, the post, the brace, the rails and the sheeting can be readily removed from one another, so they can all be readily transported and re-used.

In one construction the sides of the trough can taper downward, such that one or more troughs can be readily stacked on top of one another.

In one embodiment the trough can be provided with a single mounting plate which extends from one end of the trough to the other, and to which the post and the brace can be bolted. Preferably the mounting plate can be removed from the trough, to facilitate ready stacking of one or more troughs as described above. Therefore, in one construction the mounting plate can be of greater length than the trough, and the trough can have slots at either end through which the plate can be passed. A fixing bracket can be provided on the exterior facing surface of the trough, to which one end of the mounting plate can be bolted, to hold it in place.

However, in a preferred arrangement an external mounting plate can be removably mounted to an exterior end surface of a first end of the trough, to which the post can be mounted, and an internal mounting plate can be removably mounted to an interior end surface of a second end of the trough, to which the brace can be mounted.

A brace bracket can be provided at the top of the post, to which the brace can be bolted. The rails can be mounted to the post be means of adjustable clamps, and the sheeting can be bolted directly to the rails.

The trough can be any dimension which is large enough to contain enough ballast to carry the sheeting in use. However, in a preferred construction the trough is 1.6 meters long, half a meter wide and half a meter deep.

The ballast can be any appropriate material, however, in a preferred construction sand is used.

The invention also includes a kit of parts for one or more wall supports comprising one or more trough and one or more posts, in which each trough is substantially rectangular in shape and has a first end and a second end, and in which in use one post is disposed substantially vertically at the first end of each trough, in which in use the one or more posts carry a wall element, in which in use each trough is disposed behind the wall element and is arranged perpendicular to the wall element, and in which in use each trough carries ballast In addition, the invention further includes a kit of parts for a hoarding comprising wall means and one or more wall supports, in which each wall support comprises a trough and a post, in which the trough is substantially rectangular in shape and has a first end and a second end, and in which in use the post is disposed substantially vertically at the first end of the trough, in which in use the post carries the wall element, in which the trough is disposed behind the wall element in use and is arranged perpendicular to the wall element, and in which the trough carries ballast in use.

The kit of parts may also include one ore more braces, mounting plates, ballast, wall element and bolts or the like to fix the parts together, or any combination of these components as desired.

BRIEF DESCRIPTION OF THE DRAWINGS

The invention can be performed in various ways, but one embodiment will now be described by way of example, and with reference to the accompanying drawings in which.

DETAILED DESCRIPTION

Figure 1:
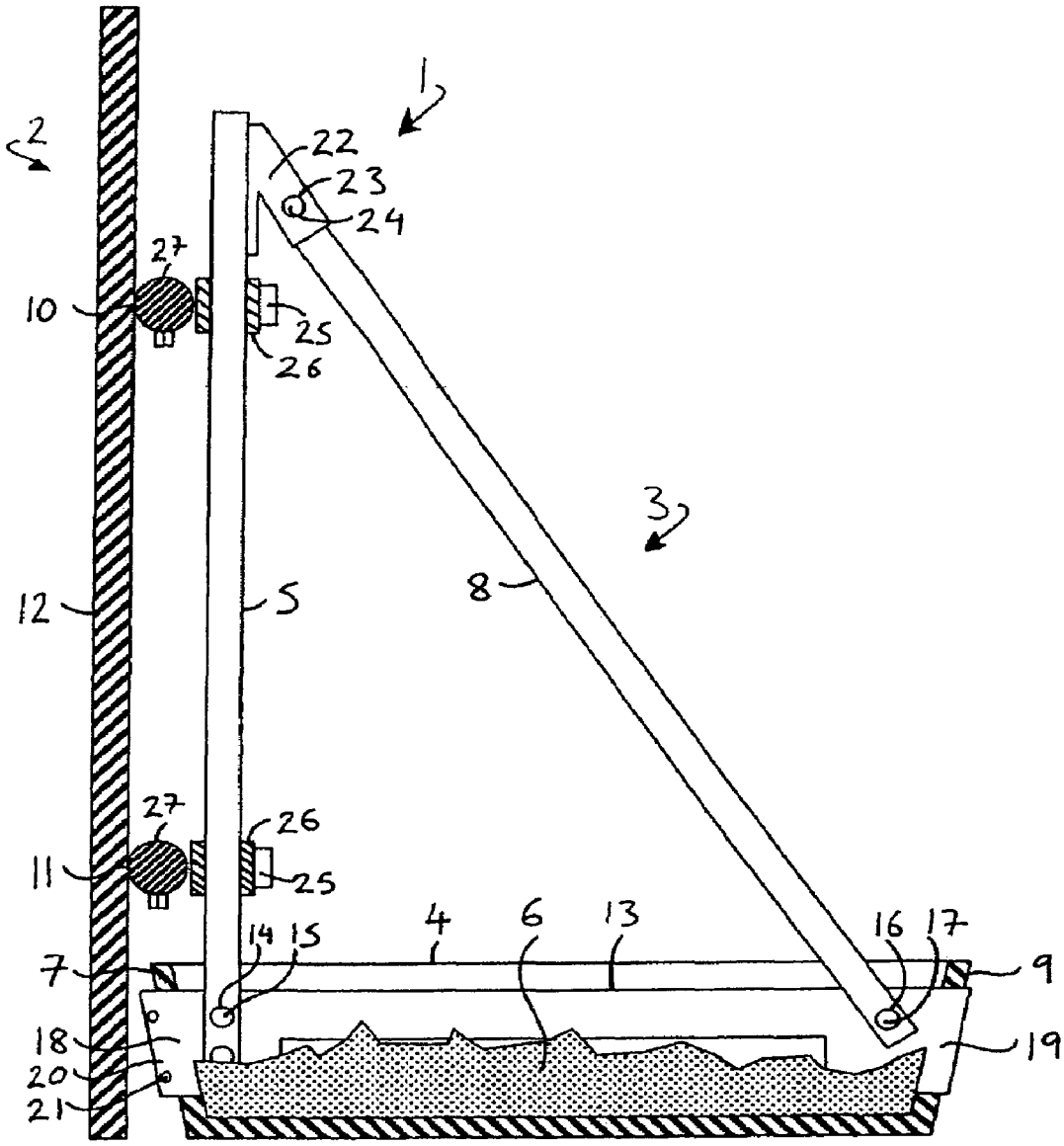
FIG. 1 is a part cross-sectional side view of a hoarding according to the present invention; and, FIG. 2 is a part cross-sectional side view of a second hoarding according to the present invention.

As shown in FIG. 1 a hoarding 1 comprises wall element 2 and one or more wall supports 3, in which the wall supports 3 comprise a trough 4, a substantially vertical post 5 connected to the trough 4 and adapted to carry the wall element 2, and in which the trough 4 carries ballast, in the form of sand 6, in use.

The trough 4 is substantially rectangular in shape, and the post 5 is disposed at a first end 7 thereof. As is shown in FIG. 1, the trough 4 extends perpendicular to the wall element 2 in use. Brace 8 extends from a second end 9 of the trough 4 to the top of the post 5, to support it.

The wall element 2 comprises two vertically spaced apart rails 10 and 11, which are mounted to the post 5. As shown in FIG. 1 the rails are arranged substantially parallel to the ground. A sheeting 12 is carried on the rails 10 and 11, and is disposed in front of the trough 4.

A mounting plate 13 is disposed in the trough 4. Post bolt apertures (not visible) are provided on the plate 13 adjacent the first end 7 of the trough 4. The post 5 is provided with bolt apertures 14, so bolts 15 can be used to fix the post 5 to the mounting plate 13.

The mounting plate 13 is further provided with brace a bolt aperture (not visible) adjacent the second end 9 of the trough 4. The brace 8 is provided with a bolt aperture 16, so bolt 17 can be used to fix the brace 8 to the brace plate 13.

Slots 18 and 19 are provided at each end of the trough 4, and the mounting plate 13 is disposed within them. A fixing bracket (not shown) is provided on the exterior surface of the first end of the trough 7, to which a first end 20 of the mounting plate 13 can be fixed, by means of bolt apertures 21.

The trough 4, the post 5, the brace 8, the rails 10 and 11 and the sheeting 12 are connected together with a number of fixings, which can be readily undone so the various components can be removed from one another, as described below.

Brace bracket 22 is provided as an integral part of the post 5. The brace bracket is provided with bolt aperture 23, and the brace 8 is provided with a corresponding bolt aperture (not visible), so bolt 24 can be used to fix the brace 8 to the post 5.

The rails 10 and 11 are connected to the post 5 be means of adjustable double clamp units 25, which comprise a post clamping portion 26 and a rail clamping portion 27. The clamp units 25 can be mounted at any point on the post 5 or rails 10 and 11.

The sheeting 12 is attached to the rails 10 and 11 by brackets of a known construction (not shown).

The trough 4, the post 5, the brace 8 and the mounting plate 13 are constructed from mild steel. The sheeting 12 is constructed from corrugated steel or plywood.

In use, the mounting plate 13 is mounted in the slots 18 and 19 and fixed to the fixing bracket (not shown) by means of the bolt apertures 21. The post 5 and the brace 8 are then bolted to the mounting 13, and to each other, and sand 6 is placed in the trough, to form the wall support 3. A plurality of identical wall supports can be constructed, depending on the size of the hoarding 1 to be erected.

The rails 10 and 11 are then attached to the post 5 of each wall support 3. In the event that the hoarding 1 is erected on uneven or sloping ground, and adjacent wall supports 3 are disposed at different levels, the clamping units 25 can be mounted at the appropriate vertical points on the post 5 which correspond to the position of the rails 10 and 11.

The sheeting 12 is then attached to the rails 10 and 11, using an appropriate fixing means (not shown).

When the hoarding is to be taken down, the above described sequence can be reversed. It will be appreciated that all the parts can then be re-used on another occasion.

As is shown in FIG. 1 the side of the trough 4 taper downward, such that the trough is of a smaller dimension at the bottom than at the top. This allows a number of troughs to be readily stacked on top of one another with the base of one trough resting on the base of another. It will be appreciated that this is only possible because the mounting plate 13 is removable from the trough 4.

Figure 2:
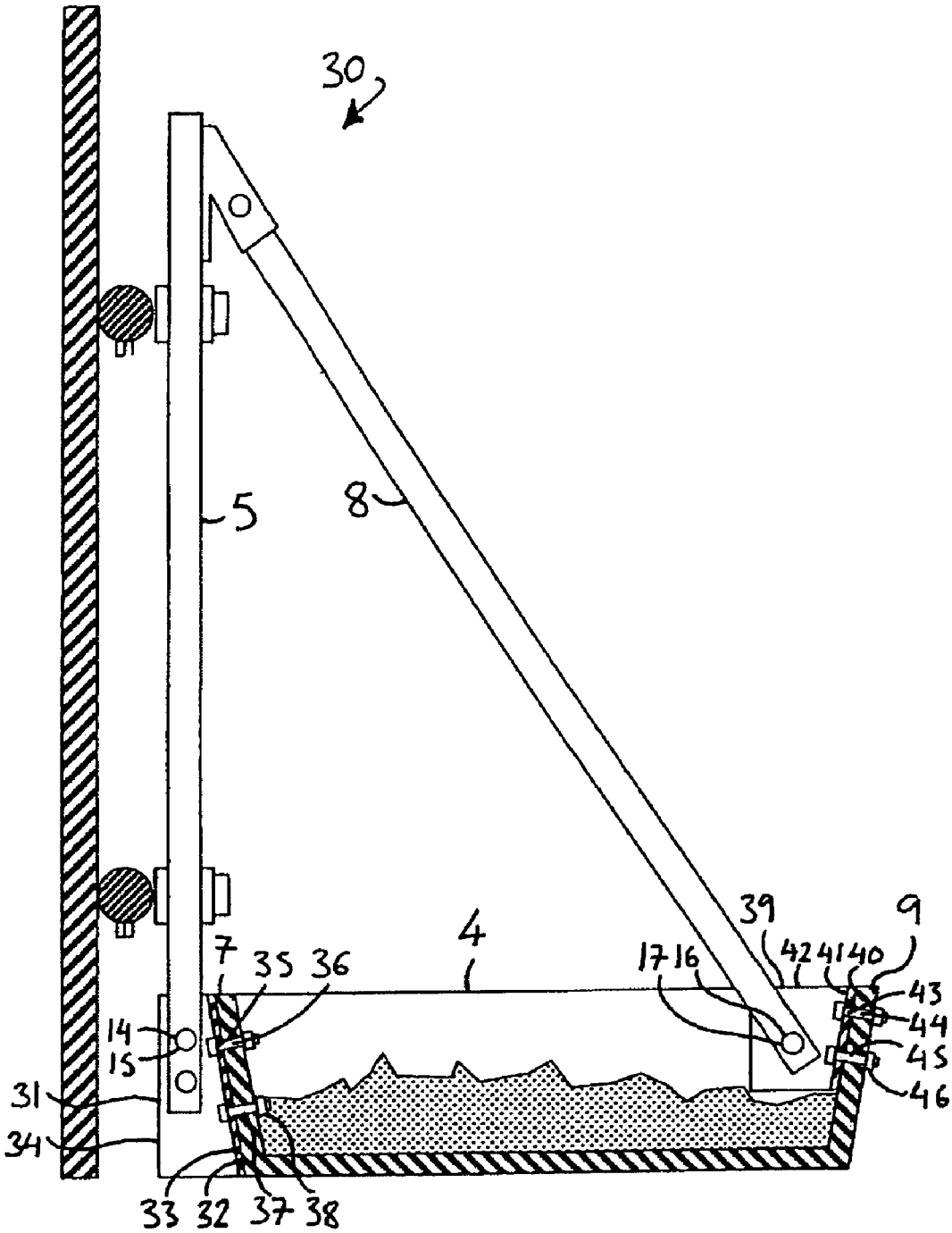

In FIG. 2 a second hoarding 30 is shown, which is similar to hoarding 1, except in the manner in which the post 5 and the brace 8 are connected to the trough 4, which no longer has slots 18 and 19. (The same reference numerals are used in FIG. 2 as in FIG. 1 where the components are identical.)

In FIG. 2 external mounting plate 31 is mounted to an exterior end surface 32 of the first end 7 of the trough 4. The external mounting plate is L-shaped, such that a first side 33 is placed against the end surface 32, and a second side 34 extends normally therefrom to provide a base for the post 5 to be secured to. Apertures 35 and 36 are provided in the in the first side 33 of the external mounting bracket 31 and the first end 7 of the trough 4 respectively, and bolts 37 and nuts 38 are used to secure the external mounting plate 31 in place.

Internal mounting plate 39 is mounted to an interior end surface 40 at the second end 9 of the trough 4. The internal mounting plate 39 is L-shaped, such that a first side 41 is placed against the end surface 40, and a second side 42 extends normally therefrom to provide a base for the brace 8 to be secured to. Apertures 43 and 44 are provided in the first side 41 of the internal mounting plate 39 and the second end 9 of the trough 4 respectively, and bolts 45 and nuts 46 are used to secure the internal mounting plate 39 in place.

Post bolt apertures (not visible) are provided on the external mounting plate 31 and the post 5 is provided with bolt apertures 14, so bolts 15 can be used to fix the post 5 to the second side 34 of the external mounting plate 31.

A brace a bolt aperture (not visible) is provided on the internal mounting plate 39 and the brace 8 is provided with a bolt aperture 16, so bolt 17 can be used to fix the brace 8 to the second side 42 of the internal mounting plate 39.

It will be obvious to the man skilled in the art how to construct and take apart the components of the hoarding 30 which are different to the components of the hoarding 1. In all other respects the hoarding 30 operates in the same manner as the hoarding 1.

The invention also includes a kit of parts for a hoarding support, and as shown in FIG. 1, that kit can comprise the trough 4 and the post 5.

The kit can further comprise the brace 8, the mounting plate 13, the ballast 6 the rails 10 and 11, clamping units 22, sheeting 12 and bolts 15, 18 and 21, or any combination of the above parts as desired.

In addition, if the kit were based on the hoarding 30 shown in FIG. 2, it could further comprise external mounting plate 31, internal mounting plate 39 and bolts and nuts 37, 38, 45 and 46, instead of mounting plate 13 and bolts 21.

The embodiments as shown in FIGS. 1 and 2 can be altered without departing from the spirit of the invention. For example, in an alternative construction (not shown) the post 5 is provided with a fitting at the top, upon which a security camera can be carried. Such posts can be provided at the wall supports 3 which are situated at the corners of building sites, or any other appropriate vantage point.

In one further alternative embodiment (not shown) the post 5 and the brace 8, can be provided with flattened sections adjacent all the bolt apertures 14, 16 and 23, to allow for a more secure fitting to the mounting plate 13, (or the external mounting plate 31 and the internal mounting plate 39) and between the post 5 and the brace 8.

In one other alternative embodiment (not shown) the wall supports can be constructed with just the trough and the post, and without the brace feature.

Thus a hoarding, and a kit of parts for a hoarding, is provided which overcomes the problems of erecting a hoarding on hard ground, and maintaining a hoarding on soft ground. Further, a hoarding is provided which can be readily erected and dismantled and stored for re-use.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A hoarding for preventing access to an area, the hoarding comprising: a wall means and one or more wall supports, in which each wall support comprises an elongate open-topped trough and a post, in which the trough is substantially rectangular in shape and has a first end wall and a second end wall which closes the ends of the trough, and in which in use the post is disposed substantially vertically at the first end of the trough, is removably connected to the trough, and is rigidly secured thereto, and in which in use the post carries the wall means which can be secured in part to the first end wall, in which the trough is disposed behind the wall means in use and is arranged perpendicular to the wall means, and in which the trough carries ballast in use, and in which sides of the trough taper downward, such that when posts are removed from a number of troughs, said troughs can be stacked on top of one another with a portion of one trough being disposed inside another trough.

2. A hoarding as claimed in claim 1 in which the post is removably connected to the first end of the through, and a brace extends from the second end of the trough to a top end of the post.

3. A hoarding as claimed in claim 2 in which the wall means disposed in front of the trough in use, extends down to the ground.

4. A hoarding as claimed in claim 1 in which a brace bracket is provided at the top of the post, to which the top end of the brace is removably connected.

5. A hoarding as claimed in claim 1 in which a mounting plate extends from the first end of the trough to the second end of the trough, and in which both the post and the brace are removably connected to the mounting plate, inside the trough.

6. A hoarding as claimed in claim 5 in which the trough is provided with a slot at the first end, and a slot at the second end, in which the mounting plate is longer than the length of the trough, in which the mounting plate extends through the slots in use, and in which a fixing bracket is provided on a exterior surface of the trough to which an end of the mounting plate extending through a slot is removably connected.

7. A hoarding as claimed in claim 5 in which the trough, the post, the brace and the mounting plate are constructed from mild steel.

8. A hoarding as claimed in claim 7 in which the sheeting is constructed from corrugated steel.

9. A hoarding as claimed in claim 7 in which the sheeting is constructed from ply wood.

10. A hoarding as claimed in claim 1 in which an external mounting plate is removably mounted to an exterior end surface of a first end of the trough, to which the post is mounted in use.

11. A hoarding as claimed in claim 10 in which an internal mounting plate is removably mounted to an interior end surface of a second end of the trough, to which the brace is mounted in use.

12. A hoarding as claimed in claim 11 in which the trough, the post, the brace, the rails and the sheeting are readily removable from one another, such that the hoarding can be dismantled.

13. A hoarding as claimed in claim 11 in which the trough, the post, the brace, the external mounting plate and the internal mounting plate are constructed form mild steel.

14. A hoarding as claimed in claim 1 in which the wall means comprises one or more rails mounted to the one or more posts, and arranged substantially parallel to the ground, and a sheeting carried on the one or more rails.

15. A hoarding as claimed in claim 14 in which the rails are mounted to the post be means of adjustable clamps, such that the rails can be mounted at any vertical point of the post, and in which the sheeting is removably bolted to the rails.

16. A hoarding as claimed in claim 1 in which the trough is substantially 1.6 meters long, substantially 0.5 meters wide and substantially 0.5 meters tall.

17. A hoarding as claimed in claim 1 in which the ballast is sand.

* * * * *

UNITED STATES PATENT AND TRADEMARK OFFICE

CERTIFICATE OF CORRECTION

PATENT NO. : 7,540,471 B2
APPLICATION NO. : 11/122628
DATED : June 2, 2009
INVENTOR(S) : Richard Hall It is certified that error appears in the above-identified patent and that said Letters Patent is hereby corrected as shown below:

Column 1, line 9, "passers by" should read --passers-by--.
Column 1, line 30, "which in which in" should read --which in--.
Column 2, line 6, "post be means" should read --post by means--.
Column 2, line 15, "more trough" should read --more troughs--.
Column 2, line 22, "ballast" should read --ballast.--.
Column 3, line 4, "with brace a bolt" should read --with a brace a bolt--.
Column 3, line 21, "5 be means" should read --5 by means--.
Column 3, line 49, "4 taper" should read --4 tapers--.
Column 3, line 66, "provided in the in the" should read --provided in the--.
Column 4, line 44, "8, can" should read --8 can--.
Column 4, line 52, "hoarding, and a kit of parts for a hoarding, is" should read --hoarding and a kit of parts for a hoarding are--.
Column 5, line 17, "through" should read --trough--.
Column 5, line 21, "use, extends" should read --use extends--.
Column 5, line 35, "provided on a" should read --provided on an--.
Column 6, line 7, "ply wood" should read --plywood--.
Column 6, line 28, "post be means" should read --post by means--.

Signed and Sealed this

Twentieth Day of July, 2010

David J. Kappos

David J. Kappos
*Director of the United States Patent and Trademark Office*